US005335905A

United States Patent [19]

Newgarden, Jr.

[11] Patent Number: 5,335,905

[45] Date of Patent: Aug. 9, 1994

[54] ROBOT TABLE TENNIS NET AND SERVER ASSEMBLY

[76] Inventor: Joseph E. Newgarden, Jr., 400 N. Belvedere, P.O. Box 959, Gallatin, Tenn. 37066

[21] Appl. No.: 151,793

[22] Filed: Nov. 12, 1993

Related U.S. Application Data

[62] Division of Ser. No. 959,266, Oct. 9, 1992.

[51] Int. Cl.[5] ..... A63B 39/00

[52] U.S. Cl. ..... 273/30; 273/29 A

[58] Field of Search ..... 473/23, 53; 273/29 R, 273/29 A, 30; 209/682, 683, 684

[56] References Cited

U.S. PATENT DOCUMENTS

| | | | |
|---|---|---|---|
| Re. 30,703 | 8/1981 | Paulson et al. | 124/1 |
| 730,188 | 6/1903 | Ek . | |
| 2,087,575 | 7/1937 | Littell et al. | 273/29 |
| 2,199,009 | 4/1940 | Perryman | 124/29 |
| 2,508,461 | 5/1950 | Lemon | 273/30 |
| 2,765,171 | 10/1953 | Cook | 273/30 |
| 2,793,636 | 5/1957 | Cook | 124/6 |
| 3,043,592 | 7/1962 | Lohr | 273/30 |
| 3,713,658 | 1/1973 | Cook | 273/26 |
| 3,761,085 | 9/1973 | Cook | 273/30 |
| 3,794,011 | 2/1974 | Newgarden, Jr. | 124/1 |
| 3,855,988 | 12/1974 | Sweeton | 124/11 |
| 3,878,827 | 4/1975 | Newgarden, Jr. | 124/1 |
| 3,911,888 | 10/1975 | Horvath | 124/11 |
| 3,917,265 | 11/1975 | Schrier et al. | 273/30 |
| 3,918,711 | 11/1975 | Zak | 273/29 |
| 3,967,821 | 7/1976 | Bagley | 473/23 |
| 3,989,245 | 11/1976 | Augustine, Jr. et al. | 273/29 |
| 3,999,754 | 12/1976 | Krzysztofiak et al. | 273/30 |
| 4,002,336 | 1/1977 | Beaver et al. | 273/30 |
| 4,046,131 | 9/1977 | Clark et al. | 124/71 |
| 4,116,438 | 9/1978 | Berliner | 273/30 |
| 4,185,824 | 1/1980 | Natwick | 273/101 |
| 4,325,351 | 4/1982 | Yuasa | 124/78 |
| 4,559,918 | 12/1985 | Ballerin et al. | 124/78 |
| 4,568,089 | 2/1986 | Jenkins et al. | 273/29 |
| 4,735,405 | 4/1988 | Marocco | 273/30 |
| 4,844,458 | 7/1989 | Gatchel et al. | 273/30 |
| 4,854,588 | 8/1989 | Gatchel et al. | 273/30 |
| 4,895,366 | 1/1990 | Bartasius | 273/29 |
| 4,917,380 | 4/1990 | Gatchel et al. | 273/30 |
| 4,948,129 | 8/1990 | Bartasius | 273/29 |
| 4,997,185 | 3/1990 | Bartasius | 273/29 |
| 5,009,421 | 4/1991 | Gatchel et al. | 273/30 |

FOREIGN PATENT DOCUMENTS

| | | | |
|---|---|---|---|
| 2141965 | 3/1973 | Fed. Rep. of Germany | 473/23 |
| 2532236 | 3/1976 | Fed. Rep. of Germany . | |

*Primary Examiner*—Theatrice Brown

*Attorney, Agent, or Firm*—Polster, Lieder, Woodruff & Lucchesi

[57] ABSTRACT

A net and trough assembly for a robot table tennis ball serving device the trough is foldable for storage in a carrying case. The net of the assembly has a dual net arrangement for surrounding a robot to capture balls in the trough in order to feed balls back to a robot. The net contains a rear ball impervious net and a forward net designed to allow balls striking the forward net at a predetermined velocity to pass through the forward net, then strike the rear net and finally drop in the trough. Balls striking the forward net with insufficient velocity to penetrate the forward net will also drop into the trough assembly. The trough employs a pair of removable ball dams positioned in the trough on opposite sides of a robot to create a storage area for the balls. A hole of predetermined size in each dam serves as a go/no-go gauge for ball sizing.

4 Claims, 7 Drawing Sheets

ROBOT TABLE TENNIS NET AND SERVER ASSEMBLY

This is a divisional of copending application Ser. No. 07/959,266, filed on Oct. 9, 1992.

BACKGROUND OF THE INVENTION

This invention relates to a robot server assembly for serving table tennis balls, and more specifically to a robot server assembly that is collapsible, portable, and employs a unique dual net feature to capture balls hit back at the robot so as to allow the balls to be fed to the server and reused.

Table tennis is a popular, competitive and recreational sport. The object of the game is to have a player on each side of the table so that each player can serve, return and rally a table tennis ball. Often, however, a player may wish to play the game of table tennis without another player. To that end, various table tennis ball serving devices or robots have been developed. The devices serve the ball to the player so that the player can return the shot in the direction of the robot. Many of the devices known to the art, however, lack functional useful or effective means of capturing the ball returned by the human player and recycling the ball to the robot server.

For example, U.S. Pat. No. 2,087,575 to Littell et al. describes a device that can be employed in table tennis, for example, for ejecting light weight balls. The device includes an overhead supply means, typically in the form of an overhead hopper which is fed by a conveyor system having a series of ball carrying members mechanically mounted for movement in a continuous loop.

U.S. Pat. No. 2,508,461, to Lemon describes an apparatus for ejecting table tennis balls and employs pressurized air, as from a home vacuum cleaner, to propel and eject balls from a conduit. A gravity fed collector box is provided for introducing a ball into a lower portion of the conduit. The Lemon device provides no control on the entrance of the balls, and failure of the balls to feed properly can result in a loss of air pressure particularly as a plurality of balls are introduced into the system.

U.S. Pat. No. 3,917,265, to Schrier, is another pneumatic ball ejecting machine including pneumatic means for transporting the balls from a collection source, for loading the balls to an ejection means and for ejecting the balls. Again, maintenance of air pressure in the device is critical. Furthermore, the device does not disclose an effective means for catching the return shot and feeding it to the ejector mechanism.

U.S. Pat. No. 4,116,438 to Berliner, describes a device for throwing table tennis balls, having a mechanical throwing means including two flexible, thin throwing discs extending generally parallel with respect to each other for grasping a table tennis ball between them and ejecting it along a guide. The balls are returned to the serving disc by pneumatic means.

U.S. Pat. No. 2,793,636 to Cook, describes a fan operated device as does U.S. Pat. No. 3,911,888 to Horvath.

U.S. Pat. No. 3,989,242, to Augustine, discloses a device for ejecting conventional tennis balls and also discloses an enclosure means including netting for catching served balls hit by a player.

My own U.S. Pat. No. 3,794,001, to Newgarden, describes a relatively simple device for imparting variations in the amount of spin applied to a ball being served by the server. The disclosure of my patent is intended to be incorporated herein by reference.

I am also a joint inventor of U.S. Pat. Nos. 4,844,458; 4,854,588; 4,917,380; and 5,009,421 which discloses a portable table tennis serving device including a robot server and a ball capture net. This device employs the use of one collapsible net which cooperates with the robot so that returned balls are fed automatically to the robot. A folding net structure is also employed for attachment to a table tennis table and for feeding balls to a robot ball server. The single net structure includes a plurality of arms extending radially from a central member and netting suspended between the arms. The netting has a lower edge which is cooperatively connected with a trough device for receiving balls that fall from the netting. The trough is disposed to feed the balls to the robot serving device. The disclosures in the above described patents are incorporated by reference herein.

It can be seen that, for the most part, the robot serving devices of the prior art do not disclose ball catching mechanisms. Those table tennis balls serving assemblies which do include catch nets commonly employ a single net design where the ball strikes the net and drops into a trough so that the ball can be fed back to the robot.

Several problems are involved with such ball catching assemblies of the prior art. First of all, such devices employ a standard single net construction. The net is suspended behind the robot serving device. When the robot serving device serves the ball, the player can strike the ball back at the net. However, a returned ball that strikes the single net configuration under high velocity can bounce off of the net back onto the playing surface, or can carom off of the net onto the floor. The prior art single net configurations are more convenient than no catch net at all; however, they are not entirely effective at stopping all shots for capturing balls and feeding them back to a robot server. Also, the robot server is often mounted toward the front of the device so that it protrudes out of the netting and is precariously close to the table itself. With such designs, the returned balls often strike the exposed robot and bounce out of play. Moreover, the robot can intrude upon table space required for the game.

Robots work best with table tennis balls of the proper diameter and near perfect roundness. Misshapened or large balls can cause the robot to jam or malfunction and cause excessive wear. Robot assemblies of the prior art do not provide a means for eliminating bad balls before loading them in the devices.

Furthermore, although the nets of the previous designs are intended to be collapsible, or foldable, the designs do not allow them to be completely folded into a convenient configuration for carrying. Even when folded, the nets of the prior art assembly extend outward from the base of the robot so as to be inconvenient for storage. Assemblies known to the prior art have awkward and complex mechanism for attaching the assembly to the table. The prior art assemblies are not designed for ease of storage and carrying and lack effective means for keeping all components of the assembly, as well as the table tennis balls used with the assembly, together in one group and as compact unit when not in use.

SUMMARY OF THE INVENTION

It is therefore an object of the present invention to provide a table tennis ball serving assembly that employs a two-net configuration so as to completely trap any balls that strike the assembly and drop the balls into a return mechanism.

Another object of the invention is to provide a table tennis serving assembly that employs a side wing net assembly that completely surrounds the robot server's end of the table tennis table so as to effectively capture balls struck toward the sides of the table as well as those returned directly toward the robot server.

Yet another object of the invention is to provide a robot serving assembly that is completely collapsible and foldable for carrying or storage.

Still another object of the invention is to provide an assembly that employs a simple, quick release attachment mechanism that can be folded out of the way for carrying and storage.

A further object of the invention is to provide a table tennis robot serving device assembly that employs the use of ball dams so as to consolidate the table tennis balls for convenient carrying or storage.

A still further object of the invention is to provide an assembly that employs a go/no-go gauge means with which the user can gauge the size and shape of the table tennis balls used in the assembly so that any misshapened or oversized balls can be removed from the assembly.

Generally stated, the robot serving assembly of the present invention employs a base container and a robot removably mounted to the rear thereof so that the lower front portion of the robot can receive table tennis balls pooled in the base container. The assembly has a net structure with arms pivotably mounted on the rear of the base container so that the arms can be fanned out with netting suspended between the arms for surrounding the robot. In another preferred embodiment of the assembly, the net assembly employs side wing nets that extend from the far end of the table along the sides of the table to the midline of the table thereby capturing balls returned to the edge of the table. The assembly employs a separate trough assembly that cantilevers horizontally from the base container and is below yet is cooperatively connected to the net so as to capture balls that are stopped by the net and for feeding balls to the robot server. The assembly further employs a forward net suspended in front of the net assembly which is designed to allow a table tennis ball striking the forward net at a predetermined velocity to pass through the forward net, thereby causing that ball to lose velocity and fall into the trough. The assembly also contains a quick release attachment mechanism which is foldable for easy storage.

DESCRIPTION OF THE PREFERRED EMBODIMENT

Figure 1:
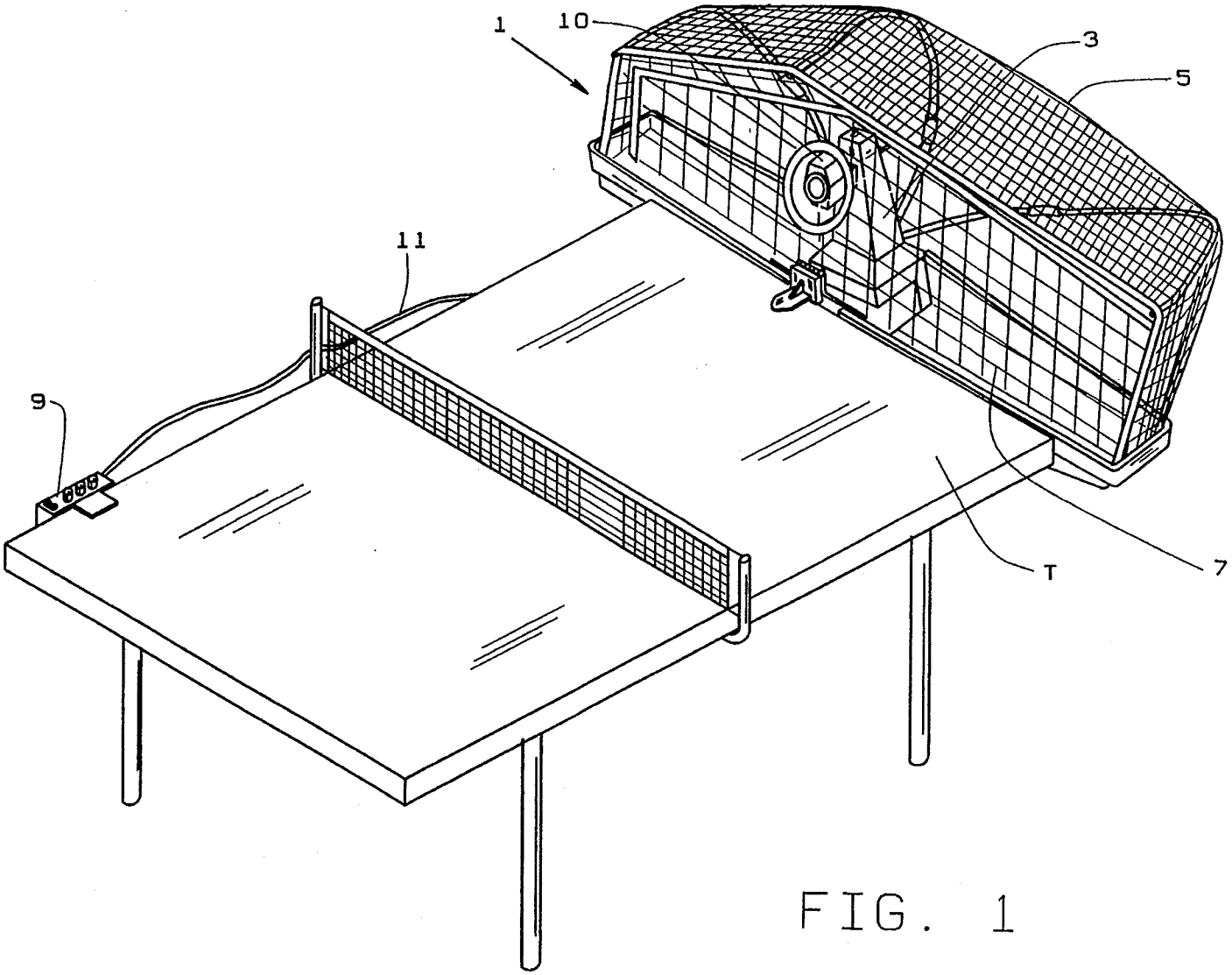
FIG. 1 is a perspective view of the robot table tennis net and server assembly of the present invention mounted on a table to illustrate environment.

Referring now to the drawings, reference numeral 1 indicates one illustrative embodiment of the robot ball serving assembly of the present invention which is shown as being attached to a table tennis table T to demonstrate environment.

In general, assembly 1 contains the robot server 3, with ball expeller 10 mounted thereon, a first net assembly 5, a forward net 7, and a remote control unit 9 connected to robot server 3 by wire 11. The remote control unit 9 is designed to mount on the end of table T opposite assembly 1 so as to be easily accessible to a player positioned at table T at the opposite end from assembly 1. Each of the particular elements of assembly 1 will be described in detail hereinafter.

Turning now to a more detailed description of the server assembly as best illustrated at FIGS. 2–7, server assembly 1 contains a robot server 3 removably mounted within base container section 13. The description and operation and function of robot server 3 is described in aforementioned U.S. Pat. Nos. 4,854,588 and 4,917,380, for example, such the descriptions and operative functions are herein incorporated by reference. Robot 3 is removably mounted within container 13 by appropriate means such as nut and bolt assemblies, for example, wing nut assemblies or the like (not shown).

Figure 5:
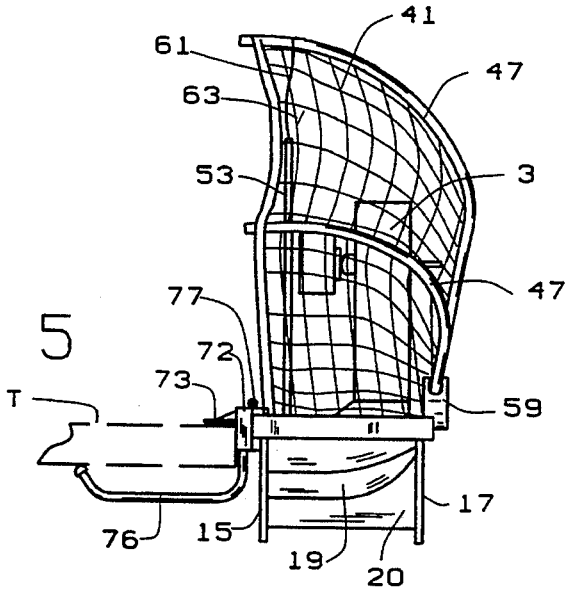
FIG. 5 is a side elevational view of the robot table tennis net and server assembly of the present invention.

Base container section 13 is of a generally rectangular configuration and is constructed to hold a plurality of table tennis balls. Container section 13 has a front vertical panel 15 and a rear vertical panel 17 (FIG. 5). Vertical panel 17 has means (not shown) for supporting wing nut assemblies or other appropriate means in order to mount robot 3 to an inner surface of rear vertical panel 17. Container 13 has two end panels 20 and 23, respectively, (FIGS. 5 and 7) which extend upwardly and are of a substantially lesser height than front panel 15 and rear panel 17 so as to accommodate the mounting of trough sections 19 and 21, as will be explained hereinafter.

As stated above, table tennis balls can be held in container 13 and can roll or flow into the open mouth section 4 of robot 3 so as to engage the internal working mechanism of robot 3 and thereby be expelled from robot 3, as described in my earlier patents. Since robot 3 is mounted on rear panel 17, mouth 4 faces the front of the assembly. In use, a pool of table tennis balls forms within container section 13 so as to provide a continuous source of balls to mouth 4 of robot 3. Furthermore, ball dams 25 and 25 can be slidably mounted in container section 13 so as to create a closed container (FIG. 6) to hold the pool of balls in one place when the assembly is collapsed for carrying or storage, as will also be explained hereinafter.

Figure 6:
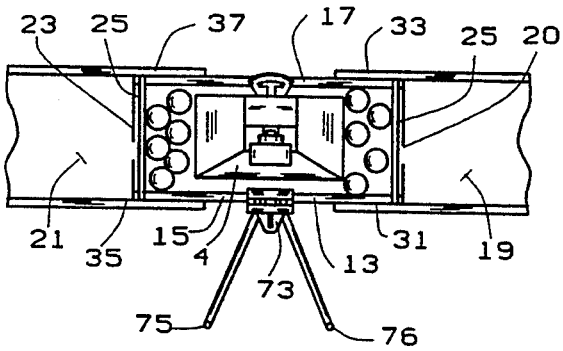
FIG. 6 is a partial, top plan of the robot table tennis net and server assembly of the present invention illustrating ball dam function.
Figure 7:
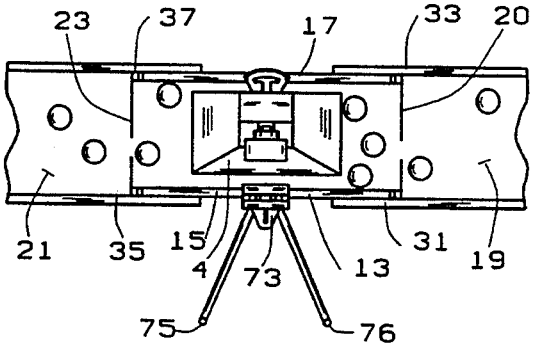
FIG. 7 is a partial top plan of the robot table tennis net and server assembly of the present invention illustrating the ball trough.
Figure 8:
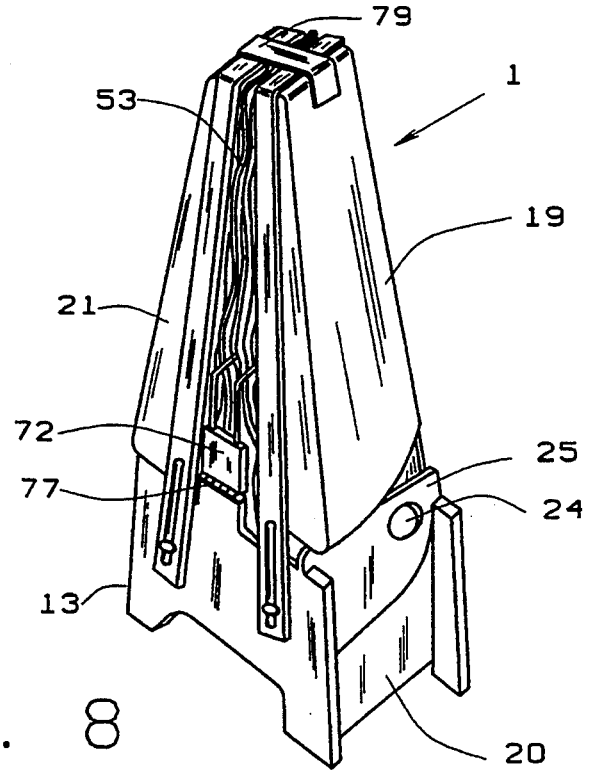
FIG. 8 is a perspective view of the robot table tennis net and server assembly of the present invention folded for carrying or storage.
Figure 9:
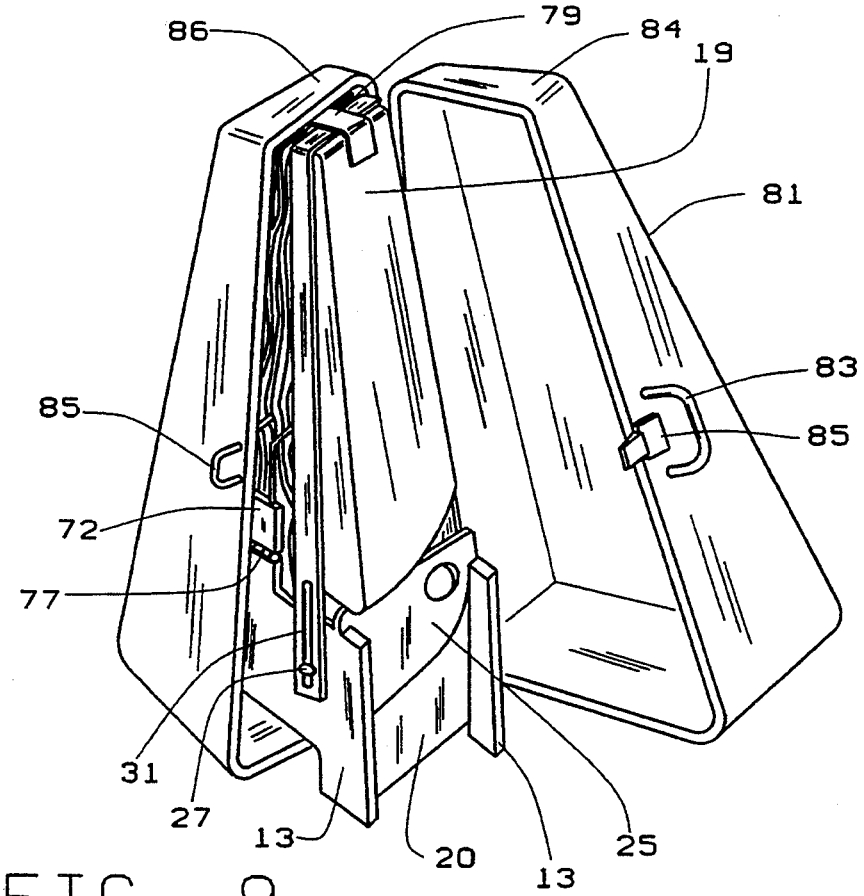
FIG. 9 is a perspective view of the robot table tennis net and server assembly of the present invention folded for carrying or storage in an optional carrying case.

As stated above, base container 13 is cooperatively connected to troughs 19 and 21 (FIGS. 5 and 7). In collapsed position, troughs 19 and 21 are positioned above side walls 20 and 23 and are hingedly connected, for example, at hinges 27 and 29 through cantilever arms 31, 33, 35, and 37, respectively (FIGS. 6 through 9). This cantilever design allows troughs 19 and 21 to clear walls 20 and 23 and ball dams 25 when troughs 19 and 21 are folded upwardly for storage or carrying (FIGS. 8 and 9). The bottom side edges of troughs 19 and 20 rest against the tops of walls 20 and 23 so that the troughs cooperatively engage container 13. Troughs 19 and 21 slope slightly toward container 13 so that balls falling into troughs 19 and 21 will flow toward the pool of balls formed in section 13. Table tennis balls fall into troughs 19 and 21 from net assembly 5, as will now be described.

Figure 2:
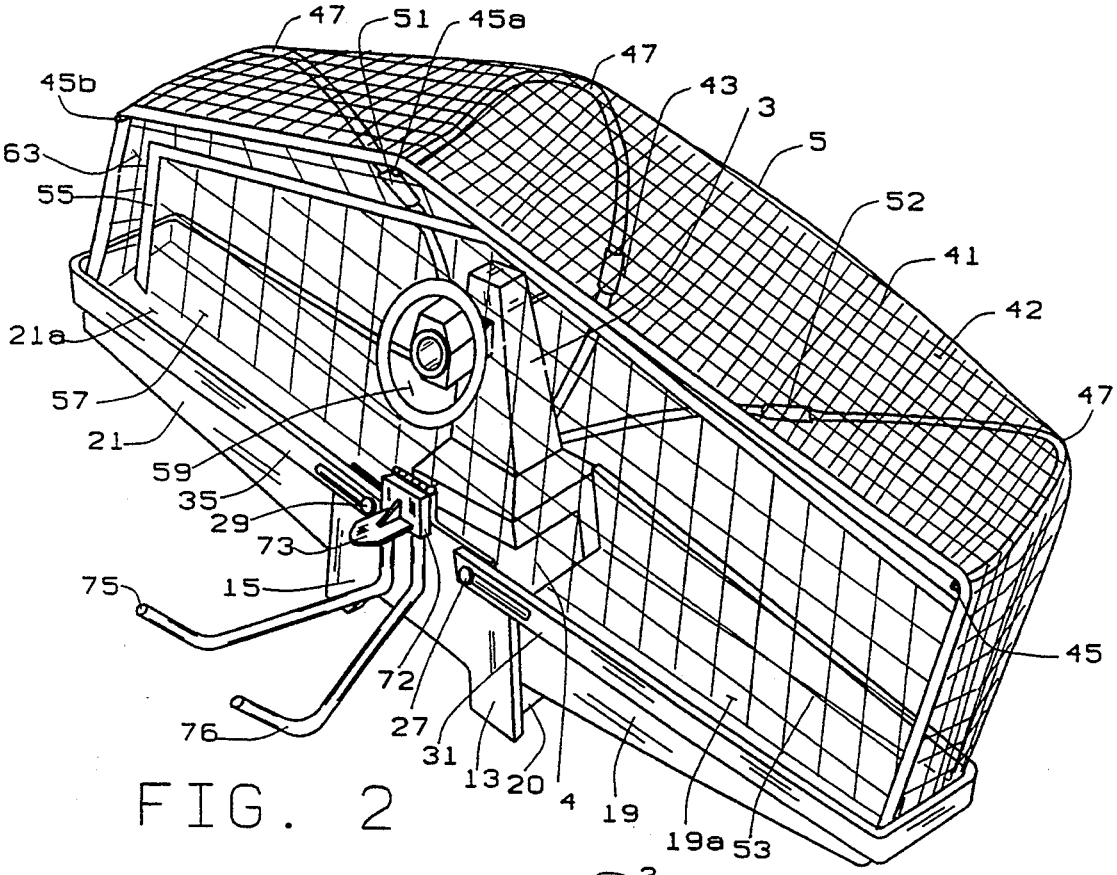
FIG. 2 is a perspective view of the robot table tennis net and server assembly of the present invention.

Net assembly 5, as best illustrated in FIGS. 2–5 is constructed of a table tennis ball impenetrable or, impassable net 41. Net 41 is a mesh-type net which may be constructed from many appropriate materials or fibers such as cotton, nylon or other materials. A plurality of openings or holes formed in net 41, as shown at 42, are of such dimensions as to be impenetrable to a table tennis ball striking net 41 at any velocity (see FIG. 10). Furthermore, the elasticity of net 41 should not be such as to allow holes 42 to spread upon the force of the striking table tennis ball, allowing the ball to pass through net 41. Net 41 has a solid edge 43 around the periphery to bind the netting in its desired shape (FIG. 2). Edge 43 can have small pockets (not shown) or other means located for example at 45, **45*a*, and 45*b*** to engage or hold arms for supporting the net, as described below.

Figure 3:
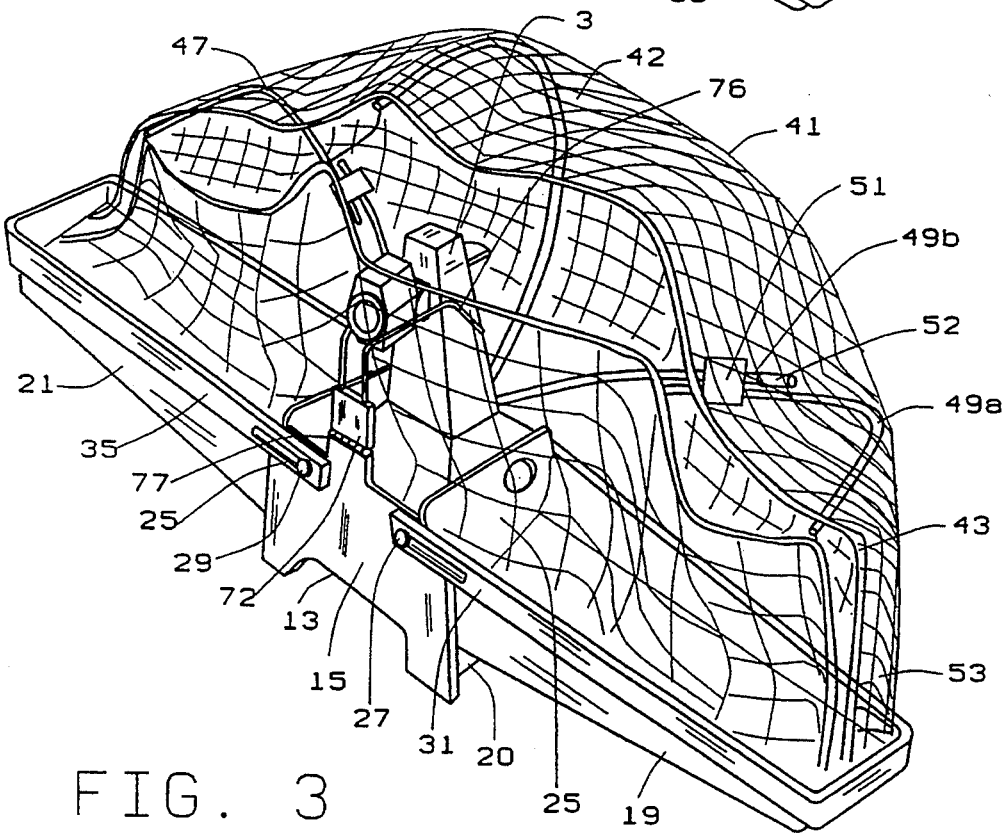
FIG. 3 is a perspective view of the robot table tennis net and server assembly of the present invention in a partial state of collapse.
Figure 4:
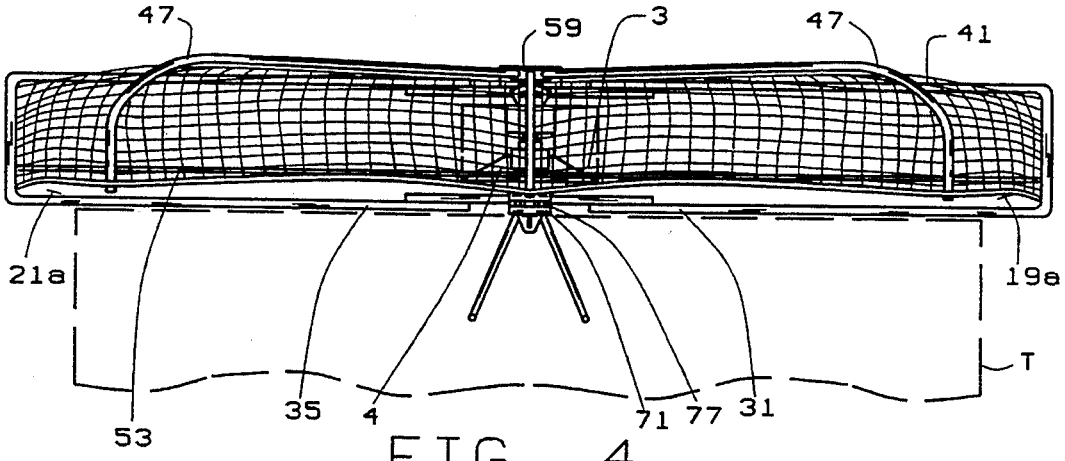
FIG. 4 is a top plan of the robot table tennis net and server assembly of the present invention.

Net 41 is stretched across a plurality of arms. In the illustrative embodiment three such arms are employed to support net 41, the arms shown generally as at 47. The arms 47 are, in general, rigid, curved rods constructed in two separable sections as shown as **49*a* and 49*b* in FIG. 3. The two sections are connected by a suitable connector means 52 in which the rods are connected end-to-end in a male, female relationship. A securing means 51 may contain channels or clips or other means for securing the two separated sections in a side-by-side relationship when the arms are disassembled, for folding or storage as shown in FIG. 3**.

Arms 47 are pivotally mounted and radiate out from an arm securing means 59 which is affixed to external side of panel 17, as shown in FIG. 5. Arm securing means 59 allows lateral movement of the arms so that arms 47 can be pivoted or fanned out for use or can be folded upward for carrying or storage.

Net 41 is suitably attached above and along one side of troughs 19 and 21 by appropriate attachment means (not shown) so as to form a contiguous, ball impenetrable barrier around the ends and back edge of troughs 19 and 21, as well as around container section 13, thereby forming a contiguous net assembly around robot 3. As best shown in FIG. 5, edge 43 of net 41 is aligned with the front edge of the troughs 19, 21 so that net 41 completely surrounds robot 3 and troughs 19, 21.

A second or forward net 53 (shown as 7 in FIG. 1) is suspended in front of net 41 to substantially enhance the ball trapping properties of net assembly 5. As noted in the background of the invention, in prior art assemblies employing a single net assembly, a table tennis ball may strike the net with sufficient force to careem away from the assembly and out of use.

Figure 10:
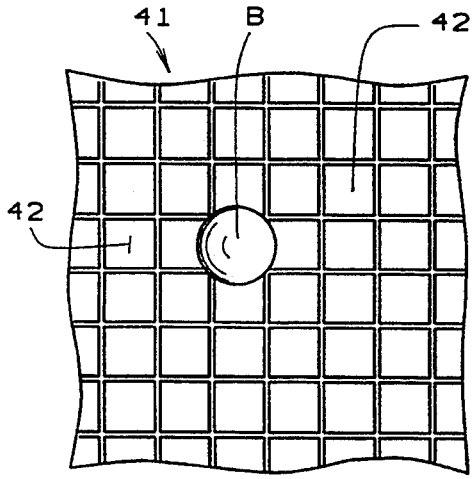
FIG. 10 is a partial, enlarged view of the net assembly illustrating the impenetrable net.
Figure 11:
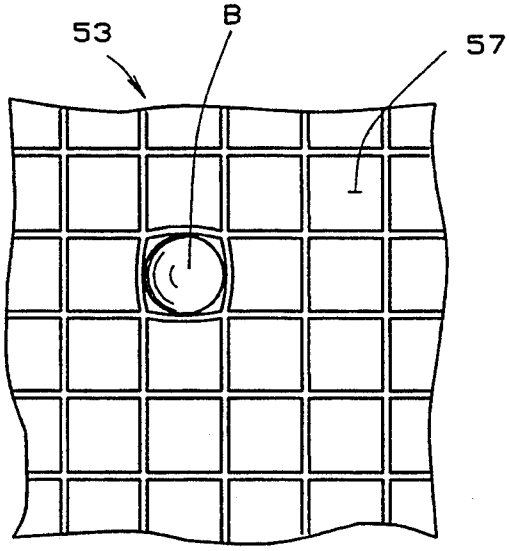
FIG. 11 is a partial, enlarged view of the forward net of the present invention illustrating a ball passing through the forward net.

Forward net 53 eliminates that disadvantage. Forward net 53 is constructed from a suitable material or fiber such as cotton or nylon and has solid edge 55 defining the shape thereof. A plurality of holes, as at 57, are formed therein and are formed in the appropriate size or dimension so as to allow a table tennis ball striking net 53 at a pre-determined velocity to pass through a particular hole 57. The dimensions of holes, 57 relative to a table tennis ball, is best illustrated at FIG. 11. It has been found in one preferred embodiment that an opening 57, of the dimensions $1\frac{1}{2}$ inches by $1\frac{1}{2}$ inches is optimum so as to allow a table tennis ball at a pre-determined velocity to pass through hole 57 of net 53 (FIG. 11) and strike net 41 (FIG. 10).

Net 53 is suspended from net 41 by appropriate hanging or suspension means as shown at 61 in FIG. 5. The top of net 53 is suspended below edge 43 of net 41 to create an opening or gap 63 between net 41 and forward net 53.

Figure 12:
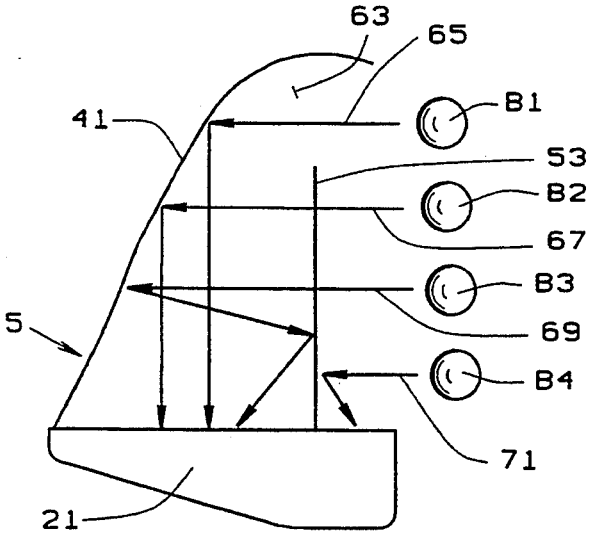
FIG. 12 is a schematic illustrating the various dispositions of balls striking the net assembly of the present invention.

The spacial arrangement between rear net 41 and forward net 53 works most effectively to trap balls as best illustrated in FIG. 12. Forward net 53 is suspended in front of and slightly below net 41 creating gap 63 between the top of net 41 and the top of net 55. A ball, as at B1 returned to net assembly 5 by a player is captured and drops into trough 19 or 21 in a variety of ways as will now be explained.

First, as illustrated by arrow 65, a ball passing above forward net 53 through gap 63 will strike net 41 and drop directly into trough 21. Gap 63 is of such dimensions and is positioned relative to nets 41 and 53 so that a ball passing through gap 63 will strike net 41 at an angle that will cause ball B to drop into trough 21.

Arrow 67 illustrates a second possible disposition of a ball shot back at net assembly 5. As shown by arrow 67, ball B2 hit with sufficient velocity will pass through opening 57 (see FIG. 11) in net 53 but will lose velocity, strike net 41 and drop into trough 21.

Arrow 69 illustrates the disposition of ball B3 passing through net 53 with sufficient velocity so as to bounce off net 41 and strike the back side of net 53 and fall into trough 21. As illustrated by arrow 69, ball B loses sufficient velocity or kinetic energy by passing through net 53 and by striking net 41 that it lacks sufficient velocity to penetrate net 53 from the back side, thereby causing ball B3 to bounce off the back side of net 53 and drop into trough 21.

Arrow 71 illustrates a final possible disposition of a ball struck back at net assembly 5. Holes 57 (FIG. 11) in net 53 are of such a pre-determined dimension as to allow the passing of a ball at sufficient velocity so as to penetrate net 53. Where, however, as illustrated by arrows 71, ball B4 strikes at a velocity insufficient to penetrate the holes in net 53, the ball will simply drop into trough 21 in front of net 53. A ball striking net 53 with insufficient velocity to penetrate net 53 will lack the energy to bounce off net 53 out of play and will drop into trough 21.

Turning now to the continuous ball feeding aspects of the invention, as stated above, the net arrangement causes the ball, as returned toward net assembly 5 by the player, to drop into troughs 19 or 21 and roll toward the pool of balls contained in container 13. Robot 3 is positioned to the rear of container 13 so that mouth 4 faces forward to accept balls from the pool of balls. Troughs 19 and 21 are formed from a suitable lightweight, semi-rigid material such as plastic or fiberglass. The depth of the trough is greater near robot 3 so that the internal floor 19*a* and 21*a* of troughs 19 and 21 respectively (FIG. 4) slope downward toward container 13 to act as ramps for the balls to roll down. As described above, troughs 19 and 21 abut the top of side panels 20 and 23, respectively, forming a closed ball return configuration.

Assembly 1 is attached to table T by a suitable mounting means. In one illustrative embodiment, the mounting means is constructed with plate 72 having a top protruding member 73 with a friction member such as hard rubber (not shown) on the bottom side thereof designed to rest on top of table T, and two opposed, splayed, protruding bottom members, 75 and 76 extending well beyond the length of top member 73 and designed to brace against the bottom side of a table to allow the assembly to rest on the table secure under its own weight. The attachment assembly is designed to be a quick mount and quick release assembly. The assembly can be easily attached to the end of the table by sliding top member 73 and bottom legs 75, 76 onto the end of the table. The assembly can be quickly and easily removed by grasping the assembly, lifting slightly up and forward so that member 73 is spaced upwardly from the table top and then legs 75 and 75 are slipped from under the table. Plate 72 is attached to the exterior of panel 15 by hinge 77 to allow the attachment means to be pivoted up and out of the way for compact carrying or storage as will now explained. It should be noted, however, that there may be alternative configurations for the attaching means without departing from the scope of the present invention.

The assembly of the present invention is collapsible, as well as foldable for storage and carrying. FIG. 1 illustrates all components of the game, fully assembled for use on a table; FIG. 2 illustrates assembly 1 in detail; and FIG. 3 illustrates the assembly 1 in the first stage of collapse and folding. As noted above, ball dams 25 have been inserted so that the balls can be pooled in container 13 for storage.

In order to understand the collapsible features of the device, FIG. 3 demonstrates arm sections 49*a* and 49*b* disassembled and secured in side-by-side relationship by fastener 51 as previously explained. Rear net 41 and forward net 53 are collapsing. Plate 72 is folded up along hinge 77 so that bottom leg members 75 and. 76 straddle robot 3 and are thus out of the way for storage and carrying.

FIGS. 8 and 9 illustrate the assembly folded for carrying or storage. Troughs 19 and 21 assume a nearly vertical position with the nets, the arms, and robot server nested inside. Ball dams, as at 25, are in place to hold the balls within container 13. Although not shown in the drawings, remote control unit 9 (FIG. 1) can be stored within container 13 so that all components of the assembly are conveniently packed. A strap 79 can be fastened by velcro or a simple latch or other means from trough 19 to trough 21 to hold the folded assembly tightly in place. FIG. 9 illustrates folded assembly 1 inside an optional carrying case shown generally at 81. Case 81 can be made of any appropriate material, for example, molded plastic with two halves 84 and 86 and a hinge (not shown) and latch 85 to allow closing. Case 81 has a handle means 83 thereon for carrying.

Figure 13:
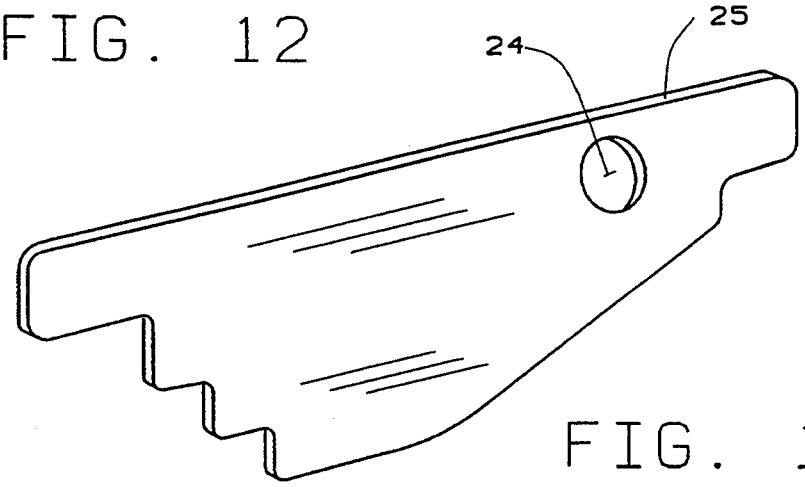
FIG. 13 is a perspective view of a ball dam component of the present invention.

A ball dam, as at 25, is illustrated in more detail at FIG. 13. Ball dams 25 and 25 are constructed of appropriate material, for example, high impact plastic. Ball dam 25 is generally a web structure having a general, peripheral configuration the same as the internal configuration of container 13 so that ball dam 25 can be slidably mounted into slots formed inside of container 13 and effectively close off container 13 as shown in FIG. 6. It should be noted that ball dams 25 and 25 can function to hold the balls outside of container 13 as well, that is, dams 25 and 25 can be used to retain the balls on the trough side of each dam so that robot 3 can be disengaged from container 13 while retaining the net assembly and troughs, with the balls contained therein, on the table. Each dam 25, as illustrated in FIG. 13, has a hole 24 formed in one end thereof. Hole 24 is the diameter of a table tennis ball in near perfect roundness. Hole 24 thus functions as go/no-go gauge for the sizing of table tennis balls for use in the assembly. Robot 3 functions most efficiently with table tennis balls of the appropriate size and near perfect roundness. Some commercially available table tennis balls are of low quality and can be of various diameters, misshapened, and out of round. In use, the player can attempt to pass a table tennis ball trough hole 24. The ball should be rotated in hole 24 during testing to be sure the ball is evenly round throughout all possible diameters of the ball. Also, balls should pass through hole 24 with very little clearance. If the ball passes with too much clearance, it may be too small. If the ball fits through hole 24, the ball is of the proper size and roundness to work efficiently in robot 3; if the ball will not pass through hole 24, the ball is either too large or too misshapened to be used effectively within robot 3 and the ball should be discarded. This unique feature improves the game in that it prevents time consuming jamming of robot 3 as well as damage to robot 3 by misshapened or incorrectly sized balls.

Figure 14:
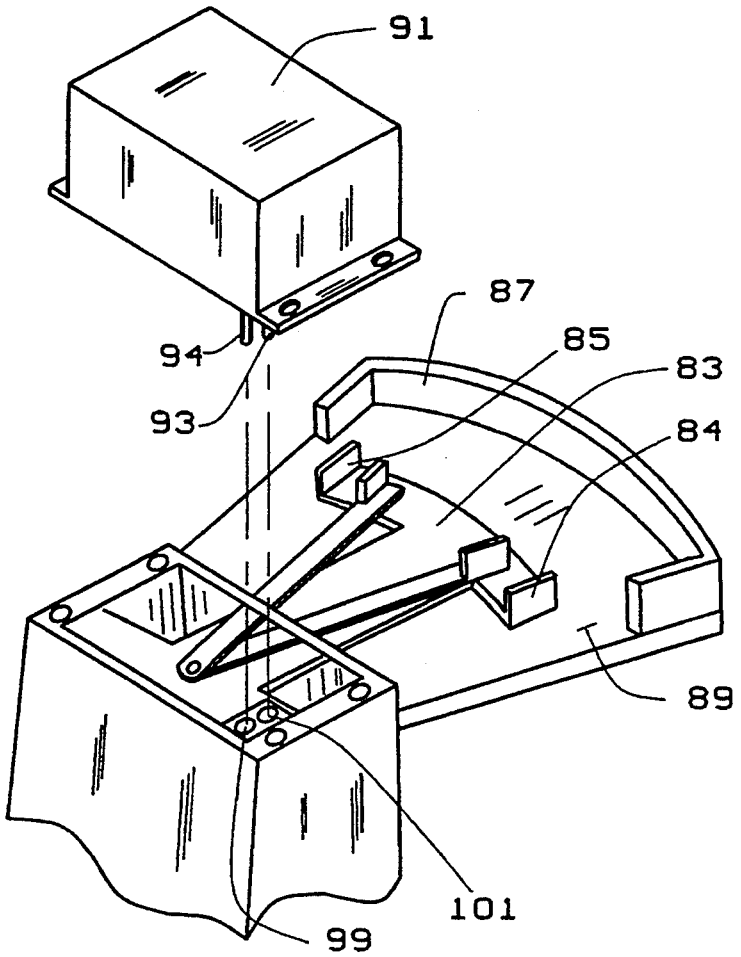
FIG. 14 is an exploded view of the panning head and panning mount assembly of the present invention.
Figure 15:
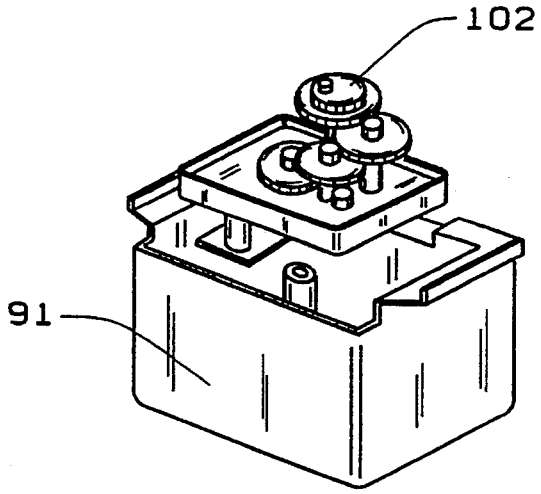
FIG. 15 is an exploded bottom plan view of the panning head.

FIGS. 14 and 15 illustrate the panning head assembly of the present invention. The automatic panning head is shown generally at 91. Panning head 91 contains plug contacts 93 and 94 and can be operated by a player through remote unit 9 (FIG. 2). Plug contacts 93 and 94 are inserted into receptacle holes 99 and 101 to complete electrical contact with control box 9. Panning head 91 can be controlled by the player so that it automatically moves levers 83 and 85 to change the side-to-side position of ball expeller 10 (FIG. 1). FIG. 15 illustrates the working mechanism of panning head 91. When panning head 91 is connected to the server, gear 102 engages levers 83 and 85 while rotating so as to move the levers and the connected ball expeller 10 back-and-forth. Guard 87 extending up from lever base 89 is designed to prevent lever grips 84 and 85 from becoming entangled in the netting.

Figure 16:
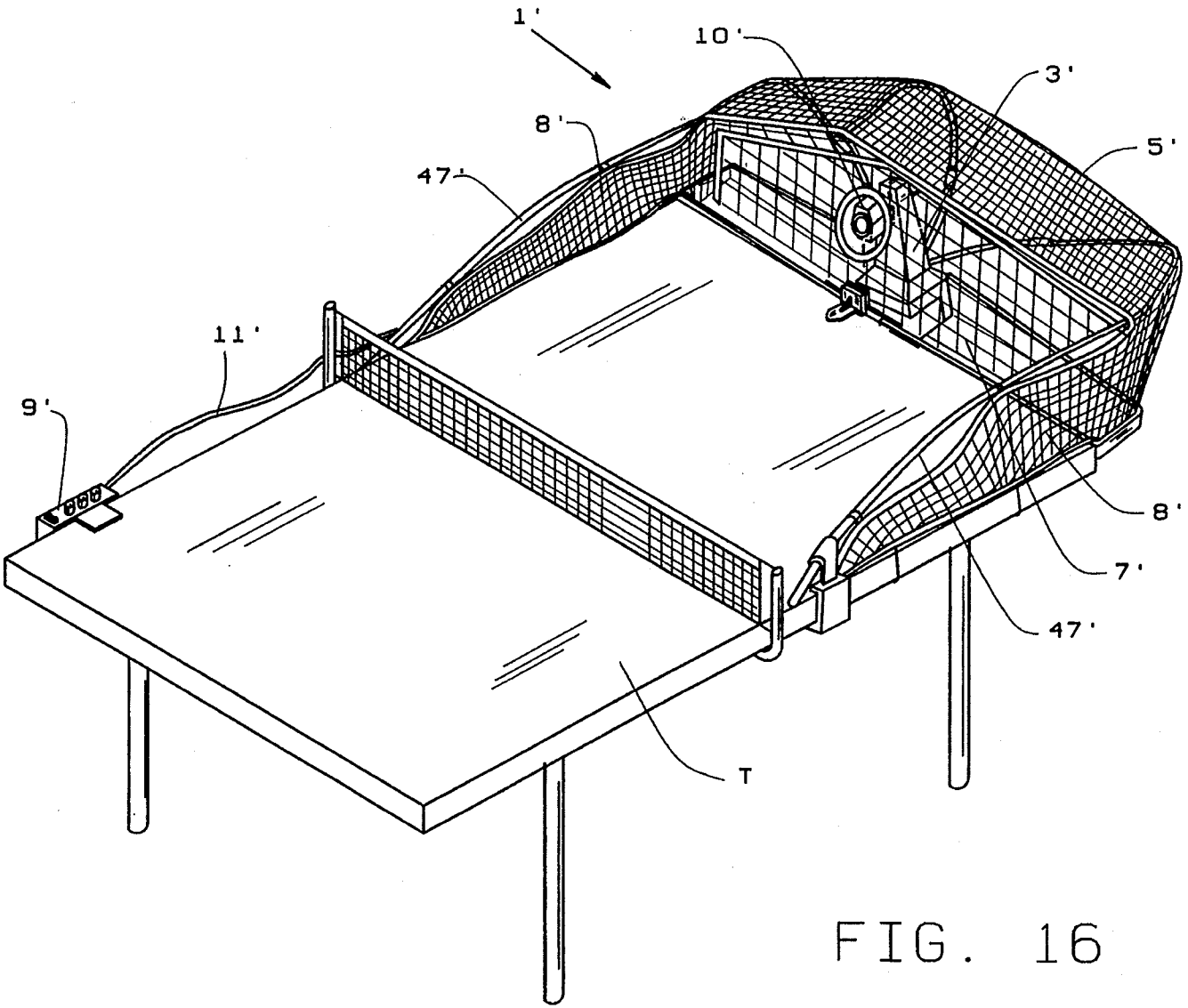
FIG. 16 is a perspective view of another embodiment of the table tennis net and server assembly of the present invention.

FIG. 16 illustrates another embodiment of the robot table tennis net and server of the present invention shown generally at 1'. The assembly 1' contains the robot server 3', having a ball expeller 10', a first net assembly 5', a forward net 7', and pair of side wing nets 8' to prevent balls from escaping over the side edge of table T, and a remote control unit 9' connected to robot server 3' by wire 11.

Side wing nets 8' are suspended from curved, rigid rods 47' which extend down the side of table T to the middle of table T. As stated above, this unique configuration prevents balls hit back toward robot 3' from rolling off or leaving the edge of table T.

Numerous variations, within the scope of the appended claims, will be apparent to those skilled in the art in light of the foregoing description and accompanying drawings. For example, the design and aesthetic appearance of the robot, the nets, the troughs or the carrying case may be varied and other objects of this invention. These variations are merely illustrative and do not limit the scope of the invention.

Having thus described the invention, what is claimed and desired to be secured by Letters Patent is:

1. A net and trough assembly for a Tobot ball server comprising:

a first net suspended above and along one side of a foldable trough for catching balls dropping from said first net and for feeding the balls to a robot server positioned in front of first net and operatively associated with said trough;

a second net, said second net suspended in front of said first net above and along a second side of said foldable trough, said second net being constructed to allow table tennis balls to pass through said second net from the front but preventing said table tennis balls from passing back through second net from the rear, thereby trapping said balls between said first and second nets and allowing said trapped balls to drop into said trough; and a pair of ball dams, said ball dams being constructed so as to be removably mountable within said trough, each said ball dam being mountable on an opposite side of said robot server for creating a pool of balls surrounding said robot so that said table tennis balls remain around said robot server when said foldable trough is folded up and to keep balls away from said server if so desired.

2. The net and trough assembly of claim 1 wherein at least one of said ball dams has a hole formed therein, each hole being formed to the exact diameter and shape of a table tennis ball, said hole serving as a go/no-go round ball gauge whereby the user can pass a table tennis ball through said hole to determine if the ball is the proper size of shaped in a rounded or out of round condition.

3. The net and trough assembly of claim 1 wherein said ball dams are formed of high-impact plastic.

4. The net and trough assembly of claim 1 wherein said ball dams have a side profile corresponding to the cross sectional profile of said foldable trough.

* * * * *

UNITED STATES PATENT AND TRADEMARK OFFICE

CERTIFICATE OF CORRECTION

PATENT NO. : 5,335,905
DATED : August 9, 1994
INVENTOR(S) : Joseph E. Newgarden, Jr.

It is certified that error appears in the above-indentified patent and that said Letters Patent is hereby corrected as shown below:

Column 9, Line 18, delete "Tobot" and insert -- Robot --

Signed and Sealed this

Twenty-fourth Day of January, 1995

*Attest:*

Bruce Lehman

BRUCE LEHMAN

*Attesting Officer*

*Commissioner of Patents and Trademarks*